US005966063A

United States Patent [19]

Sato et al.

[11] Patent Number: 5,966,063

[45] Date of Patent: Oct. 12, 1999

[54] PLANAR MAGNETIC DEVICE

[75] Inventors: Toshiro Sato; Tetsuhiko Mizoguchi, both of Yokohama, Japan

[73] Assignee: Kabushiki Kaisha Toshiba, Kawasaki, Japan

[21] Appl. No.: 08/699,439

[22] Filed: Aug. 19, 1996

[30] Foreign Application Priority Data

Sep. 7, 1995 [JP] Japan ..... 7-230324
Feb. 1, 1996 [JP] Japan ..... 8-016634

[51] Int. Cl.[6] ..... H01F 5/00; H01F 27/28

[52] U.S. Cl. ..... 336/200; 336/223; 336/232

[58] Field of Search ..... 336/200, 232, 336/223

[56] References Cited

U.S. PATENT DOCUMENTS

| | | | |
|---|---|---|---|
| 4,547,961 | 10/1985 | Bokil et al. | 336/200 |
| 5,039,964 | 8/1991 | Ikeda | 336/200 |
| 5,068,612 | 11/1991 | Auslander et al. | 336/200 |
| 5,095,296 | 3/1992 | Parker | 336/92 |
| 5,363,081 | 11/1994 | Bando et al. | 336/200 |
| 5,430,424 | 7/1995 | Sato et al. | 336/200 |
| 5,548,265 | 8/1996 | Saito | 336/200 |
| 5,559,360 | 9/1996 | Chiu et al. | 336/200 |
| 5,572,179 | 11/1996 | Ito et al. | 336/200 |
| 5,583,474 | 12/1996 | Mizoguchi et al. | 336/83 |
| 5,598,327 | 1/1997 | Somerville et al. | 336/200 |

FOREIGN PATENT DOCUMENTS 2311481 12/1976 France .

4117878 12/1991 Germany .

OTHER PUBLICATIONS

C. Sullivan et al., "Microfabrication Process for High–Frequency Power–Conversion Transformers", IEEE PESC 95 Record, pp. 658–664 (1995).

Patent Abstracts of Japan, JP4057307, vol. 16, No. 259, Feb. 25, 1992.

Patent Abstracts of Japan, JP58073105, vol. 7, No. 166, May 2, 1983.

Patent Abstracts of Japan, JP63116411, vol. 12, No. 362, May 20, 1988.

Jan Craninckx et al., "A 1.8–GHz Low–Phase–Noise Spiral–LC CMOS VCO", 1996 Symposium on VLSI Circuits Digest of Technical Papers, pp. 30–31.

Makoto Ueda, "Toshiba's Newly Developed Device Opens Way to Vast Size Reduction of Electrical Components' Power Supply Circuits", Toshiba News, Sep. 28, 1993.

*Primary Examiner*—Michael L. Gellner
*Assistant Examiner*—Anh Mai
*Attorney, Agent, or Firm*—Finnegan, Henderson, Farabow, Garrett & Dunner, L.L.P.

[57] ABSTRACT

A planar magnetic device in which the high-frequency loss in the coil conductor can be reduced. The device comprises a planar coil formed of a coil conductor constituted by a plurality of conductor lines. The coil conductor is provided in the form of a spiral. The planar coil is interposed between two insulating layers which are sandwiched between two soft-magnetic layers.

31 Claims, 14 Drawing Sheets

SIZE : 6.0 x 6.0 mm
MATERIAL OF COIL : ELECTROPLATED COPPER (50μm THICK)
COIL CONDUCTOR : 140μm WIDE
NUMBER OF TURNS : 7
SOFT-MAGNETIC MATERIAL : CoFe Si B AMORPHOUS (6μm THICK)

SIZE : 3.0 x 5.0 mm
MATERIAL OF COIL : ELECTROPLANTED COPPER (5μm x 2)
COIL CONDUCTOR : 70μm WIDE
NUMBER OF TURNS : 8
SOFT-MAGNETIC MATERIAL : CoZrNb AMORPHOUS (3μm THICK)

PLANAR MAGNETIC DEVICE

BACKGROUND OF THE INVENTION

1. Field of the Invention

The present invention relates to a planar magnetic device for use in various high-frequency components, such as a choke coil and a transformer which are to be incorporated into a switching power supply.

2. Description of the Related Art

As is demanded in the so-called multimedia age which has come recently, various portable electronic apparatuses are made smaller, thinner, lighter and more efficient. This owes much to the increased integration density of electronic circuits, which has been made possible by advanced LSI technology, advancements in component-mounting technology, and the development of high-energy battery cells (e.g., lithium cell and nickel-hydrogen cells).

The power-supply section of such an electronic apparatus has a switching type power supply which is a stable one. It is considered difficult to reduce the size and weight of the switching type power supply, without impairing the high power-converting efficiency of the power supply. The size, weight and manufacturing cost of the switching type power supply remains the same, while the those of the other components of the electronic apparatus are successfully reduced. Inevitably the switching type power supply becomes increasingly responsible for the size, weight and cost of the apparatus.

To reduce the size and weight of the switching type power supply, the switching frequency of the power supply may be increased so that the power supply may incorporate a small power-supply component, such as a small inductor, a small transformer or a small capacitor. Here arises a problem. The higher the switching frequency, the greater the energy loss in the small power-supply component, and lower the power-converting efficiency of the switching type power supply. To enable the power supply to convert high-frequency power efficiently, it is absolutely required that the small power-supply component should have but a small energy loss. Further, magnetic components, such as an inductor and a transformer, can hardly be made thinner. It therefore remains difficult to provide a switching type power supply which is sufficiently thin.

To provide a switching type power supply which is very small and thin, it has been proposed that a planar inductor or transformer be used which comprises a planar coil and a soft-magnetic film. FIG. 1A shows a conventional planar inductor. The planar inductor has a planar coil 1 which is generally square as shown in FIG. 1B. As shown in FIG. 1A, the coil 1 is interposed between two insulating layers 2, which are sandwiched between two soft-magnetic layers 3.

The planar inductor has the frequency characteristic illustrated in FIG. 2. As the higher the frequency f increases, the equivalent series resistance R rapidly increases, while the inductance L remains almost unchanged. The quality factor Q remains less than 10. Any inductance element whose quality factor Q is more than 10 is generally considered a good one. The higher the quality factor, the better. It is therefore demanded that the quality factor Q of planar inductors be increased. The high-frequency loss in each soft-magnetic layer 3 and the high-frequency loss in the planar coil 1 are regarded as preventing an increase in the quality factor Q of the planar inductor. (High-frequency loss of soft-magnetic layer is an eddy-current loss or a hysteresis loss.)

A new type of a planar inductor has been invented, which is shown in FIG. 3. This inductor comprises two insulating films (not shown), a planar coil 4 interposed between the insulating films, and two soft-magnetic layers 5 provided on the insulating films, respectively. The planar coil 4 is oblate as a whole. The soft-magnetic layers 5 are made of uniaxial anisotropic material, have a hard axis of magnetization and are magnetized in rotation magnetization mode. The eddy-current loss made in the layers 5 is therefore small. As a result, a decrease of the high-frequency loss in the layers 5 can be well expected.

The planar inductor shown in FIG. 3 has the frequency characteristics illustrated in FIG. 4. As FIG. 4 shows, the quality factor Q of the planar inductor is less than 10, at the most.

The inventors hereof analyzed the high-frequency loss in planar inductors, each comprising two soft-magnetic layers, two insulating layers sandwiched between the soft-magnetic layers and a spiral planar coil interposed between the insulating layers. The results of the analysis were as follows:

An inductor shown in FIG. 5A, comprising two soft-magnetic layers 8, two insulating layers 7 interposed between the layers 8 and a spiral planar coil 6 interposed between the insulating layers 7, had an internal magnetic flux. The flux consisted of an in-plane component Bi and a vertical component Bg, with respect to the soft-magnetic layers 8. These components Bi and Bg were distributed as illustrated in FIG. 5B.

Another inductor shown in FIG. 6A, identical to the inductor of FIG. 5A except that a meandering planar coil 9 replaced the spiral one, had an internal magnetic flux. The flux consisted of an in-plane component Bi and a vertical component Bg with respect to the soft-magnetic layers 8. These components Bi and Bg were distributed as illustrated in FIG. 6B.

From the in-plane component Bi of the magnetic flux which extending through the soft-magnetic layers 8 there was generated an eddy currents jm,p, which flowed in the direction of thickness of either soft-magnetic layers 8 as illustrated in FIG. 7. Similarly, from the vertical component Bg of the magnetic flux there was generated an eddy currents jm,i, which flowed in the surface direction of either soft-magnetic layers 8 as shown in FIG. 8.

In each of the inductors shown in FIGS. 5A and 6A, the vertical component Bg extending through the kth conductor 10 of the planar coil (6 or 9) generated an eddy current jc,l which flows along the coil conductor line 10 as shown in FIG. 9. In the spiral planar coil 6 of the inductor shown in FIG. 5A, the vertical component Bg extended in the same direction over the entire width of the coil conductor 10. Hence, as shown in FIG. 10, the density of a high-frequency current flowing through the coil conductor 10 was high at one end of the coil conductor 10 and low at the other end thereof. That is, the current density was markedly not uniform in the coil conductor 10.

In other words, the high-frequency current did not flow uniformly through the coil conductor 10. Rather, it flowed concentratedly through one end of the coil conductor 10. The resistance of the coil conductor 10 inevitably increased very much, making a large high frequency loss. This loss is considered to make it difficult to increase the quality factor Q of the planar inductor.

Furthermore, the inventors studied the increase in the high-frequency resistance of the planar coil, which had been caused by the vertical component Bg of the magnetic flux. As seen from FIG. 9, the vertical component Bg extended upwards through the kth coil conductor 10. It extended in the same direction through the same coil conductor 10. (In FIG. 9, Bgk(x) represents the density of the vertical component extending through the kth coil conductor 10.) The current flowing in the coil conductor 10 was distributed in the coil conductor 10 as indicated in FIG. 10. Namely, the current density was high in the left end of the coil conductor 10 and low in the right end thereof. This is because the eddy current jc,l generated from a vertical alternating magnetic flux was superposed on a current I supplied from an external power supply. Assuming that the density Bgk(x) of the vertical component extending through the kth coil conductor 10 is a constant one Bgk, the resistance Rc(f) the coil conductor 10 has at frequency f is given as:

$$Rc(f) = Rc(0)\cdot\left[1 + \frac{4_{\pi}^{2} f^{2}\cdot tc^{2}\cdot d^{4}}{12\rho^{2}}\cdot\frac{\sum_{k=1}^{n} Bgk^{2}\cdot lk}{\sum_{k=1}^{n} lk}\right] \quad (1)$$

where Rc(0) is the direct-current resistance of the coil conductor 10, tc is the thickness thereof, d is the width thereof, ρ is the resistivity thereof, and lk is the length thereof.

The resistance Rc(f) of the coil conductor 10, calculated by the equation (1), increases with the frequency f, along a curve a shown in FIG. 11. As the curve a shows, the calculated resistance Rc(f) increases with the frequency, almost in the same manner as the measured equivalent series resistance R of the conventional planar inductor (FIG. 2), as is shown in FIG. 2 and as is indicated by a curve b in FIG. 11.

As FIG. 11 shows, the region between the calculated value a and measured value b indicates the increase of resistance R which has resulted from the high-frequency loss made at the soft-magnetic layers 8. This increase is far less than the increase in the resistance of the planar coil itself. That is, in a planar magnetic device comprising two soft-magnetic layers and a planar coil interposed between these layers, a greater part of the high-frequency loss is the loss in the coil conductor. The high-frequency loss in the coil conductor can be said to make it difficult to increase the quality factor Q of the planar magnetic device.

The conventional planar magnetic devices descried above are planar inductors. The planar transformers hitherto known have the same problem as the planar inductors. In a conventional planar transformer, the resistance of the coil conductor increases in a high-frequency band, resulting in a high-frequency loss. This loss decreases the operating efficiency of the planar transformer.

SUMMARY OF THE INVENTION

In view of the foregoing, the object of the present invention is to provide a planar magnetic device in which a high-frequency loss in a coil conductor can be reduced.

A planar magnetic device according to the present invention comprises two soft-magnetic layers, two insulating layers interposed between the layers, and at least one planar coil interposed between in the insulating layers. The planar coil comprises a coil conductor which is constituted by a plurality of conductor lines. With this structure it is possible to suppress an increase in the resistance of the coil conductor, which occurs in a high-frequency band. The high-frequency loss in the coil conductor can therefore be decreased.

In a planar magnetic device according to the above structure, one planar coil is sandwiched between two insulating layers which are interposed between two soft-magnetic layers. The high-frequency loss in the coil conductor can therefore be reduced. The planar magnetic device can be used as a planar inductor which has its quality factor Q increased from a maximum value.

Another planar magnetic device according to the above structure comprises at least two planar coils positioned one above another, insulating layers interposed among the at least two planar coils, two insulating layers sandwiching the both planar coils, and two soft-magnetic layers sandwiching the two insulating layers. The high-frequency loss of the conductor of each planar coil is thereby decreased. This planar magnetic device can be used as a planar transformer which has an increased operating efficiency.

Still another planar magnetic device according to this structure has a planar coil is constituted by two spiral planar coils arranged side by side in the same plane and electrically connected to each other. This planar magnetic device can make a planar inductor which has a high inductance.

Another planar magnetic device according to this structure has soft-magnetic layers made of uniaxial anisotropic material and having a hard axis of magnetization and an easy axis of magnetization. An eddy-current loss of the soft-magnetic layer is small, whereby the high-frequency loss in the soft-magnetic layers can be reduced.

In each planar magnetic device described above, the at least one planar coil is an oblate spiral planar coil comprised of straight conductors located in hard direction of magnetization of the soft-magnetic layers and arcuate conductors located in easy direction of magnetization of the soft-magnetic layers. Alternatively, the at least one planar coil is a rectangular spiral planar coil comprised of conductors extending parallel to a major axis and located in hard direction of magnetization of the soft-magnetic layers and conductors extending parallel to a minor axis and located in easy direction of magnetization of the soft-magnetic layers. Since the conductors, which form a greater part of the coil (oblate or rectangular), are positioned in the hard direction of magnetization, the coil can perform its function with high efficiency.

Furthermore, each of the arcuate conductors of the oblate spiral coil is a single conductor or constituted by a plurality of conductor lines electrically connected in part, and each of the conductors of the rectangular spiral coil, which extend parallel to the minor axis, is a single conductor or constituted by a plurality of conductor lines electrically connected in part. Thus, even if some of the coil conductors are cut, the planar coil is not cut as a whole.

Another planar magnetic device of this invention comprises at least one planar coil; a pad section to be connected to an external circuit; two insulating layers sandwiching the at least one planar coil and the pad section; and two soft-magnetic layers sandwiching the insulating layers and having a hole each, which is concentric with the pad section. In this device, small magnetic flux passes through the pad section. This suppresses generation of an eddy current in the pad section more reliably than otherwise. The power loss in the pad section is therefore smaller.

Still another planar magnetic device according to the invention comprises at least one planar coil; a pad section which is to be connected to an external circuit and which has a plurality of notches cut in edges, the notches dividing the pad section into a plurality of regions; two insulating layers sandwiching the at least one planar coil and the pad section;

and two soft-magnetic layers sandwiching the insulating layers. The notches divide the loop of an eddy current generated in the pad section when a magnetic flux passes through the section, into small eddy currents. In other words, the small currents are confined in the respective regions. The eddy-current loss in the entire pad section is less than otherwise.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Embodiments of the present invention will be described below, with reference to the accompanying drawings.

First Embodiment

Figure 1A:
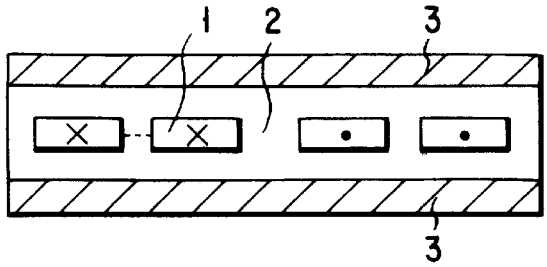
FIG. 1A PRIOR ART
FIGS. 1A and 1B are diagrams illustrating a conventional planar inductor.
Figure 1B:
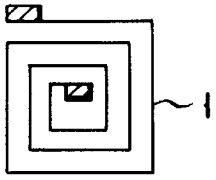
FIG. 1B PRIOR ART
Figure 2:
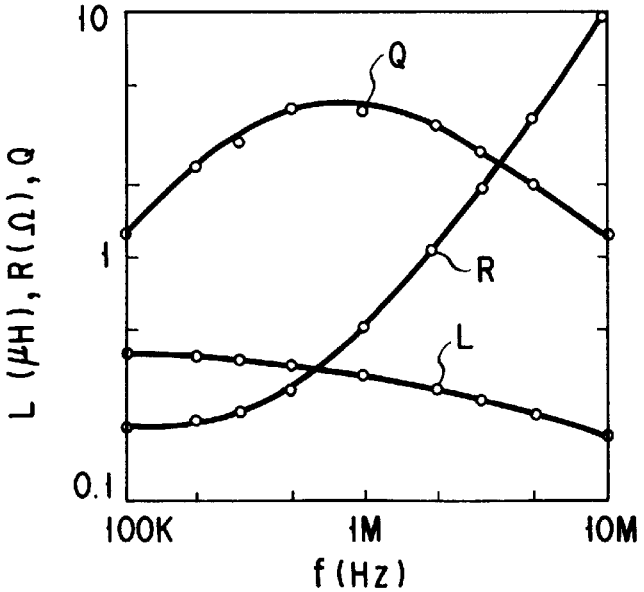
FIG. 2 PRIOR ART
FIG. 2 is graph representing the frequency characteristic of the planar inductor shown in FIGS. 1A and 1B.
Figure 3:
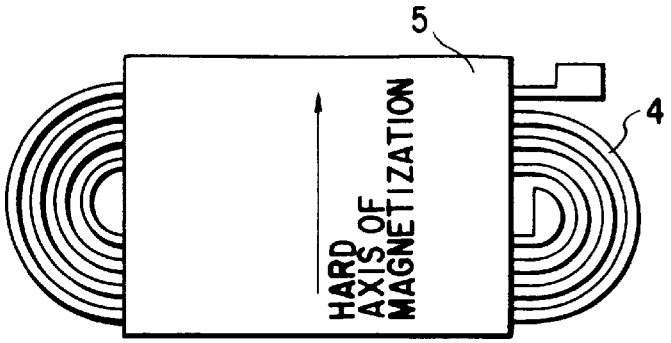
FIG. 3 PRIOR ART
FIG. 3 is a plan view of another conventional planar inductor.
Figure 4:
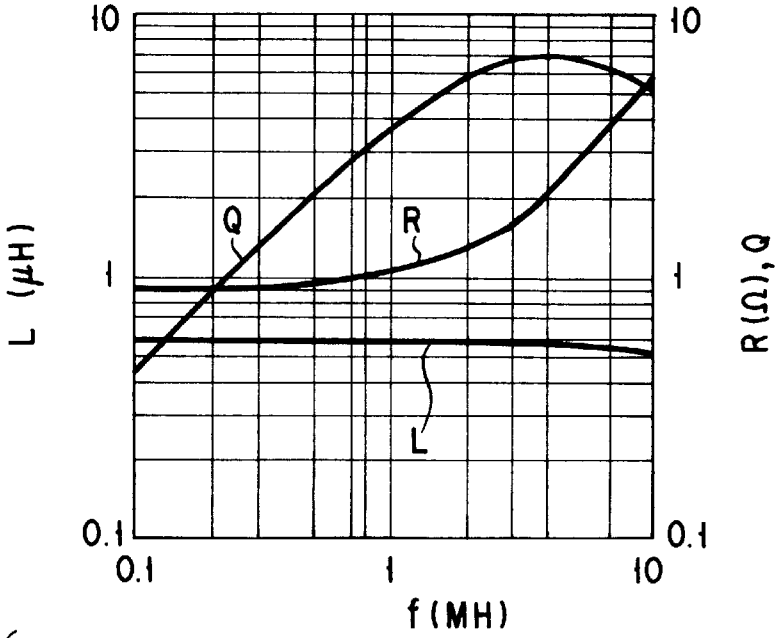
FIG. 4 PRIOR ART
FIG. 4 is a graph illustrating the frequency characteristic of the planar inductor shown in FIG. 3.
Figure 5A:
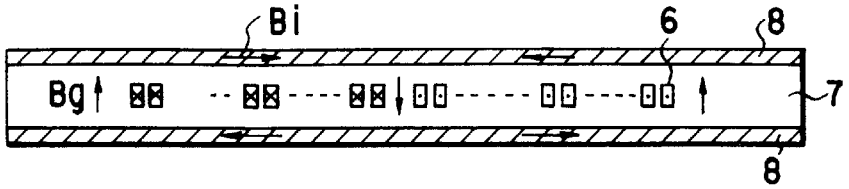
FIG. 5A PRIOR ART
FIGS. 5A and 5B are diagrams showing how a magnetic flux is distributed in a conventional planar inductor having a spiral planar coil.
Figure 5B:
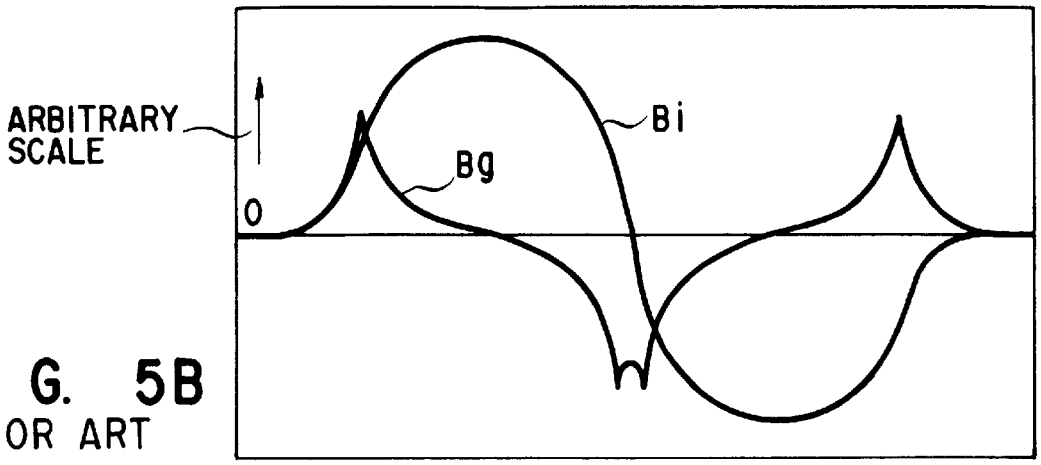
FIG. 5B PRIOR ART
Figure 6A:
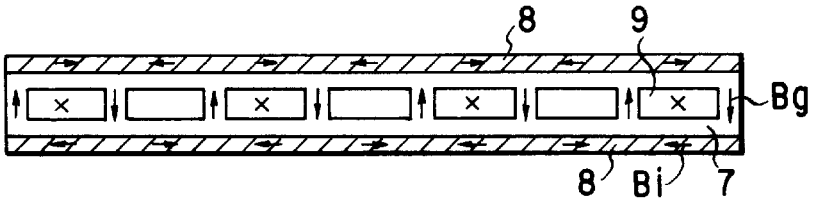
FIG. 6A PRIOR ART
FIGS. 6A and 6B are diagrams showing how a magnetic flux is distributed in a conventional planar inductor having a meandering planar coil.
Figure 6B:
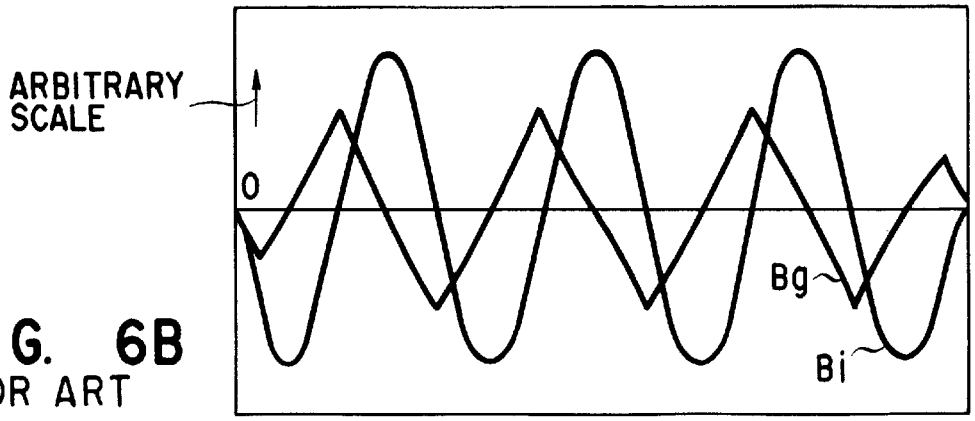
FIG. 6B PRIOR ART
Figure 7:
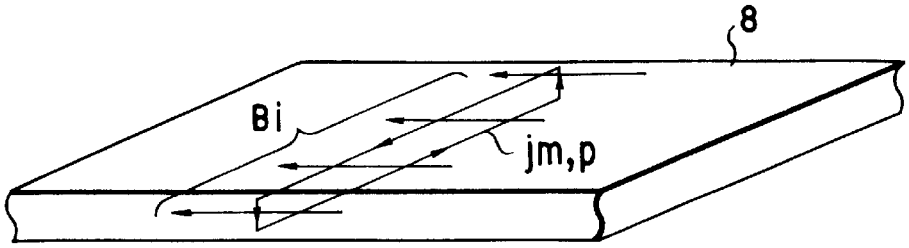
FIG. 7 PRIOR ART
FIG. 7 is a perspective view of a soft-magnetic layer, explaining the eddy current generated from the in-face magnetic-flux component in a soft-magnetic layer.
Figure 8:
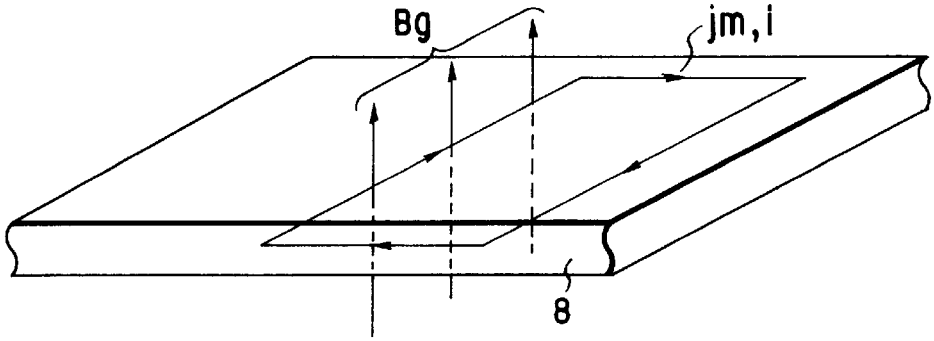
FIG. 8 PRIOR ART
FIG. 8 is a perspective view of a soft-magnetic layer, explaining the eddy current generated from the vertical magnetic-flux component in a soft-magnetic layer.
Figure 9:
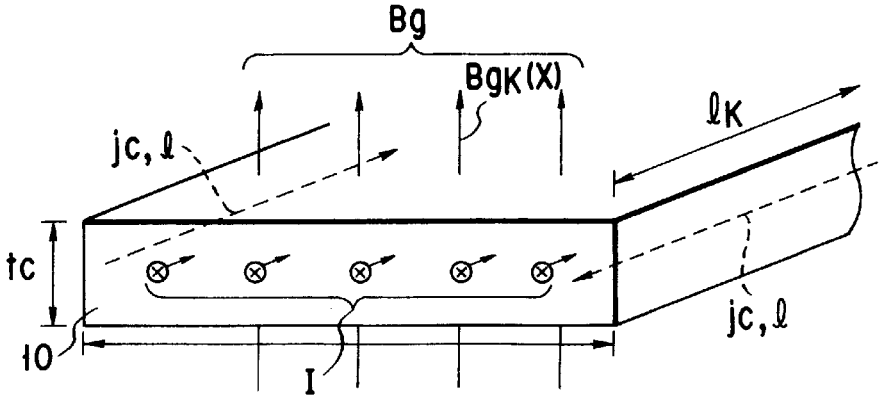
FIG. 9 PRIOR ART
FIG. 9 is a perspective view of a soft-magnetic layer, explaining the eddy current generated from the vertical magnetic-flux component in a coil conductor.
Figure 10:
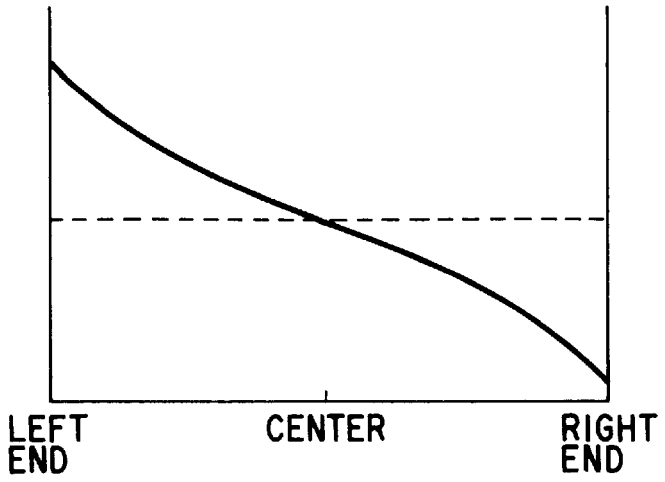
FIG. 10 PRIOR ART
FIG. 10 is a graph representing the distribution of the high-frequency current density in a coil conductor.
Figure 11:
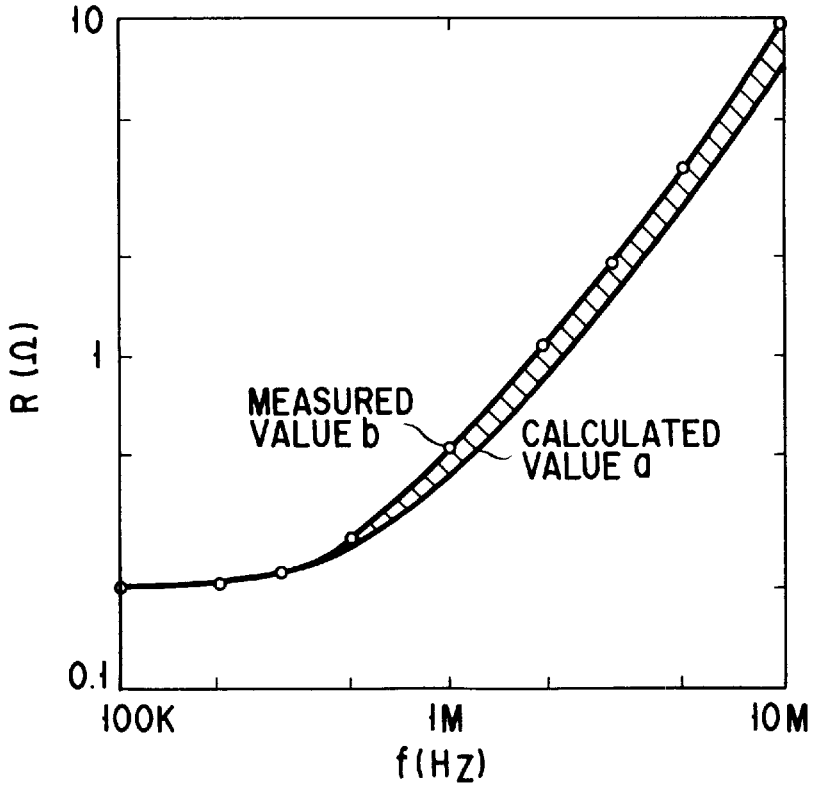
FIG. 11 PRIOR ART
FIG. 11 is a graph illustrating how a measured coil resistance of a conventional planar inductor changes with frequency and also how a calculated coil resistance of the inductor changes with frequency.
Figure 12A:
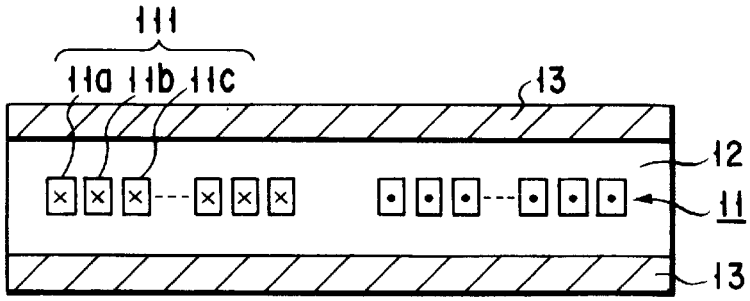
FIGS. 12A, 12B and 12C are diagrams showing the structure of a planar inductor which is a first embodiment of the present invention.
Figure 12B:
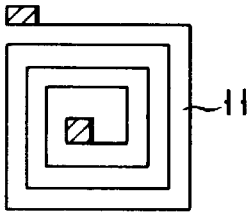
Figure 12C:
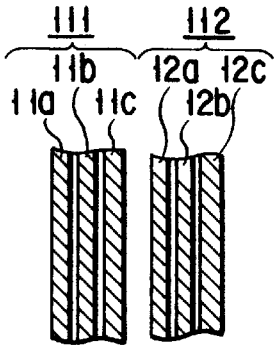

FIGS. 12A, 12B and 12C show the structure of a planar inductor which is the first embodiment of the present invention. As FIG. 12A shows, the planar inductor comprises a planar coil 11, two insulating layers 12 and two soft-magnetic layers 13. The coil 11 is interposed between the insulating layers 12. The layers 12 are sandwiched between the soft-magnetic layers 13.

As shown in FIG. 12C, the planar coil 11 has a coil conductor 111 consisting of three conductor lines 11*a,* 11*b* and 11*c*. The coil conductor 111 is a spiral as illustrated in FIG. 12B. Each of the conductor lines has been formed by performing, for example, photolithography on an conductive film such as a copper foil. The number of conductor lines forming the coil conductor 111 is not limited to three. The conductor 111 may be constituted by one conductor line, two conductor lines, or four or more conductor lines.

The conductor lines 11*a,* 11*b* and 11*c,* which constitute the coil conductor 111, are extremely narrow. In each conductor line it is therefore possible to suppress the eddy current generated from a vertical alternating magnetic flux. Hence, the conductor lines 11*a,* 11*b* and 11*c* can render uniform the distribution of a high-frequency current density which is a combination of the eddy current and a current I supplied from an external power supply, the former superposed on the latter. In other words, the high-frequency current flows substantially uniformly in each conductor line. An increase in the resistance RcN(f) of the coil conductor 111 is thereby suppressed. This reduces the high-frequency loss in the coil conductor 111.

The resistance RcN(f) is given as:

$$Rc,\ N(f) = Rc(0)\cdot\left[1 + \frac{4_{\pi}^{2} f^{2}\cdot tc^{2}\cdot d^{4}}{12\rho^{2}\cdot N^{2}}\cdot\frac{\sum_{k=1}^{n} Bgk^{2}\cdot lk}{\sum_{k=1}^{n} lk}\right] \quad (2)$$

where Rc(0) is the direct-current resistance of each coil conductor, tc is the thickness thereof, d is the width thereof, ρ is the resistivity thereof, lk is the length thereof, and N is the number of the conductor lines provided. In this embodiment, N=3.

As can be understood from the equation (2), the increase in the coil resistance RcN(f), caused by the alternating current, is only $1/N^2$ of the case where single conductor is used.

As indicated above, the eddy current generated by a vertical alternating magnetic flux can be suppressed in each of the conductor lines 11*a,* 11*b* and 11*c.* Hence, the vertical alternating magnetic flux is stable because the eddy current generates the disturbing magnetic flux. Being stable, the vertical alternating magnetic flux imposes no adverse influence on the inductance L of the planar inductor.

Figure 13:
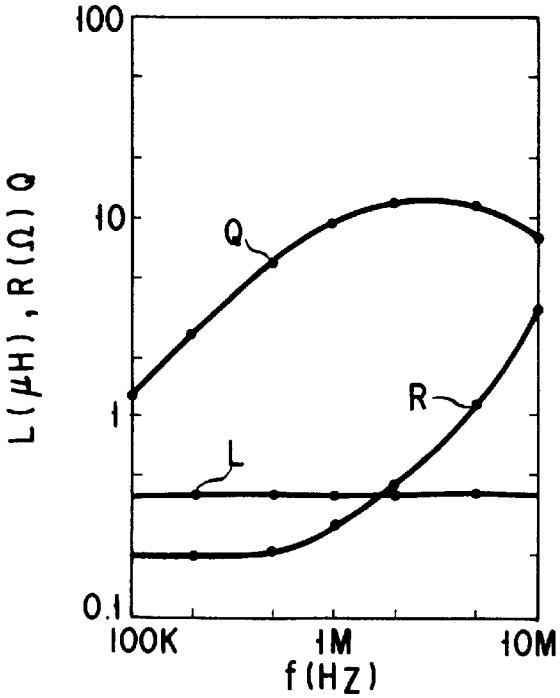
FIG. 13 is a graph representing the frequency characteristic of the planar inductor shown in FIGS. 12A to 12C.

A planar inductor of the structure shown in FIGS. 12A to 12C was made and tested for its characteristics. It exhibited the frequency characteristic illustrated in FIG. 13. As FIG. 13 shows, its inductance L remained almost unchanged even when the frequency f (Hz) was in the MHz-band. Additionally, an increase in the equivalent series resistance R was suppressed well. Furthermore, the high-frequency loss was markedly small. Still further, the quality factor Q was found to reach 12, well exceeding 10.

Figure 14A:
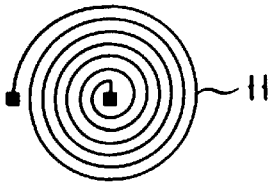
FIGS. 14A, 14B and 14C are plane views of three different planar coils which can be incorporated in the planar inductor shown in FIGS. 12A to 12C.
Figure 14B:
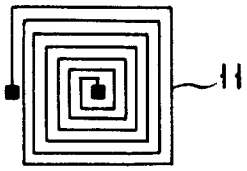
Figure 14C:
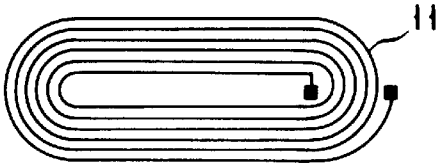
Figure 15A:
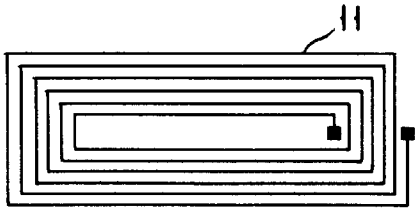
FIGS. 15A and 15B are plane views of two different planar coils which can be incorporated in the planar inductor shown in FIGS. 12A to 12C.
Figure 15B:
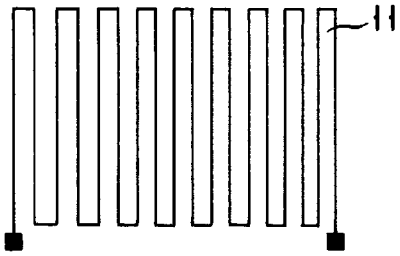

As shown in FIG. 12C, the planar coil 11 is a square spiral coil interposed between the insulating layers 12 sandwiched between the soft-magnetic layers 13. It may be replaced by a circular one as shown in FIG. 14A, an oblate one as shown in FIG. 14C, a rectangular one shown in FIG. 15A, or a meandering one shown in FIG. 15B. Needless to say, it may be a square spiral planar coil of another type illustrated in FIG. 14B. The material of the magnetic layer 13 is not limited. It may be either a ferrite-based one or a metal-based one. Whichever material it is made, the coil 11 is expected to have the same advantage.

Second Embodiment

Figure 16:
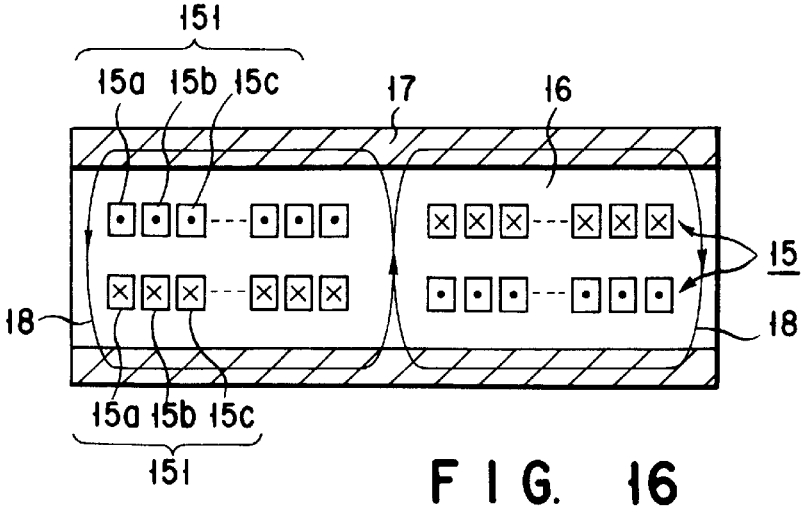
FIG. 16 is a sectional view showing a planar transformer which is a second embodiment of the present invention.

FIG. 16 shows a planar transformer which is the second embodiment of this invention. As seen from FIG. 16, the planar transformer comprises two planar coils 15, three insulating layers 16 and two soft-magnetic layers 17. The coils 15 are sandwiched between the insulating layers 16, located one above the other interposing an insulating-layer 16 between them. The layers 16 are sandwiched between the soft-magnetic layers 17.

Each of the planar coils 15 has a coil conductor 151 consisting of three conductor lines 15*a,* 15*b* and 15*c.* The coil conductor 151 is a spiral. The number of conductor lines forming the conductor 151 is not limited to three. The conductor 151 may be constituted by one conductor line, two conductor lines, or four or more conductor lines. A magnetic flux extends with respect to the planar coils 15 as indicated by the arrows shown in FIG. 16.

A planar transformer of the type shown in FIG. 16 was made and tested for its operating efficiency. As in the planer inductor of the type shown in FIGS. 12A to 12C, the high-frequency loss in the coil conductors 151 was small in a high-frequency band. Therefore, the planar transformer exhibited an operation efficiency of 90%, much higher than that of the conventional planar transformer which is approximately 70%.

Third Embodiment

Figure 17A:
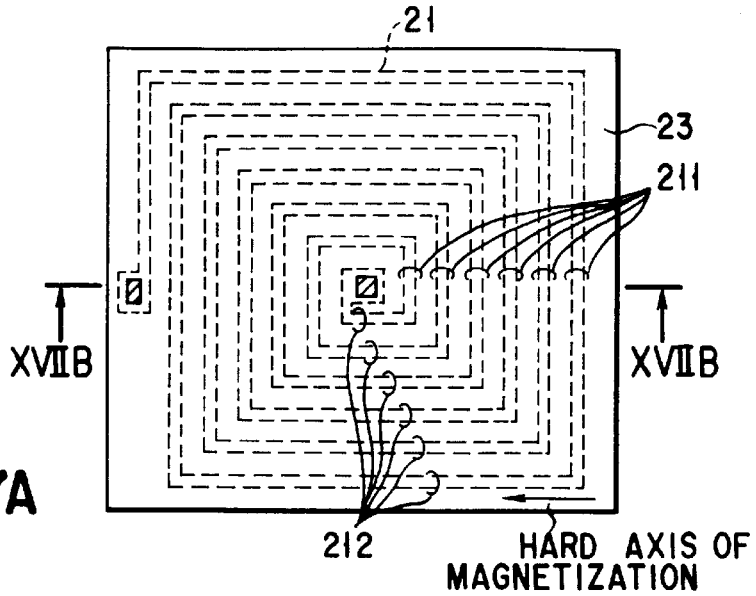
FIGS. 17A and 17B are diagrams showing a planar inductor which is a third embodiment of this invention.
Figure 17B:
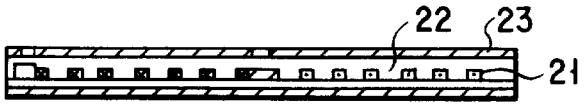

FIGS. 17A and 17B show a planar inductor which is the third embodiment of the invention. As FIGS. 17A and 17B show, this inductor comprises a square spiral planar coil 21, two insulating layers 22 and two soft-magnetic layers 23. The coil 21 is interposed between in the insulating layers 22, which are sandwiched between the soft-magnetic layers 23. The soft-magnetic layers 23 are made of uniaxial anisotropic material.

Figure 19:
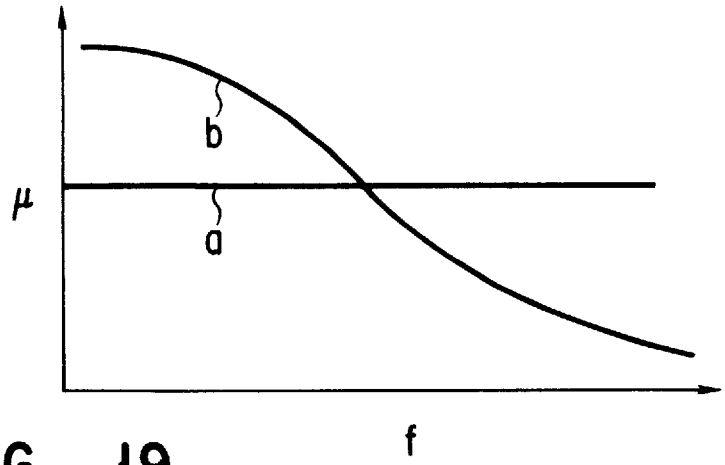
FIG. 19 is a graph indicating how the permeability of the soft-magnetic layer used in the third embodiment changes with frequency, when the layer is magnetized along the difficult axis of magnetization and the easy axis of magnetization.

Made of uniaxial anisotropic material, the soft-magnetic layers 23 have a hard axis of magnetization and an easy axis of magnetization. The permeability $\mu$ of each soft-magnetic layer 23 remains almost unchanged in a hard direction of magnetization irrespective of frequency f, as is indicated by line a in FIG. 19. By contrast, in an easy direction of magnetization, the permeability $\mu$ decreases as the frequency f rises as is indicated by a curve b in FIG. 19. As is known in the art, the magnetic-flux density in the high-frequency region is almost the same as in a hollow coil.

Figure 18A:
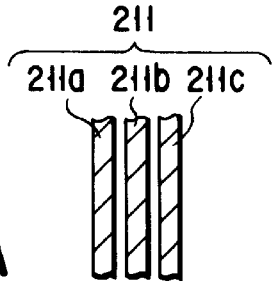
FIGS. 18A, 18B, 18C and 18D are diagrams showing the coil conductors incorporated in the third embodiment.
Figure 18B:
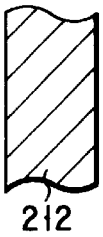
Figure 18C:
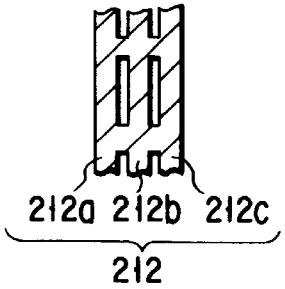
Figure 18D:
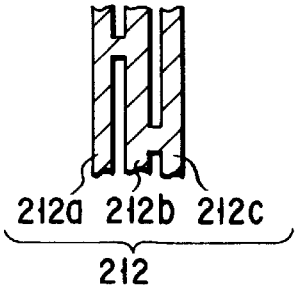

The conductors 211 of the square spiral planar coil 21, located in the hard direction of magnetization where each soft-magnetic layer 23 has a constant permeability $\mu$ in the high-frequency band, are constituted by three conductor lines 211*a,* 211*b* and 211*c* each, as is illustrated in FIG. 18A. The conductors 212 of the coil 21, located in the easy direction of magnetization, are constituted either by a single conductor or by three conductor lines 212*a,* 212*b* and 212*c* electrically connected in part. Since the conductor lines 211*a,* 211*b* and 211*c* of each conductor 211 located in the hard direction of magnetization are electrically isolated from each other, an increase in the resistance of the coil 21, which occurs in the high-frequency band, is reduced, thereby decreasing the high-frequency loss in the coil conductor. The conductors 212 of the coil 21 are constituted by a single conductor or conductor lines 212*a,* 212*b* and 212*c* electrically connected in part, because they are scarcely influenced by the vertical magnetic flux since they are located in the easy direction of magnetization, in which the magnetic-flux density is distributed in almost the same way as in a hollow coil.

As mentioned above, each conductor 211 of the planar coil 21, located in the hard direction of magnetization, is formed of three conductor lines 211*a,* 211*b* and 211*c,* and an increase in the resistance of the coil 21, which occurs in the high-frequency band, is reduced, decreasing the high-frequency loss in the coil conductor. Hence, the planar inductor can have its quality factor Q increased to a maximum value. As indicated above, the conductors 212 of the coil 21, located in the easy direction of magnetization, are constituted either by a single conductor or by three conductor lines 212*a,* 212*b* and 212*c* electrically connected in part. In the easy direction of magnetization, each soft-magnetic layer 23 has a small permeability $\mu$ in the high-frequency band and the magnetic-flux density is distributed in almost the same way as in a hollow coil. Therefore, the conductors 212 of the coil 21 are influenced but a very little by the vertical magnetic flux. An increase in the resistance of the coil 21, which occurs in the high-frequency band, is reduced, thereby decreasing the high-frequency loss in the coil conductor.

Needless to say, the conductor lines 212*a,* 212*b* and 212*c* are narrower than a single conductor which may be used to constitute each conductor 212 of the coil 21. The narrower the conductor lines 212*a,* 212*b* and 212*c,* the higher the possibility that they are cut due to dust existing while they are being formed by photolithography. Nonetheless, the planar coil 21 will not be cut as a whole since the conductor lines 212*a,* 212*b* and 212*c* electrically connected in part in the easy direction of magnetization. Hence, the coil 21 can be manufactured at a high yield and at low cost.

Figure 20A:
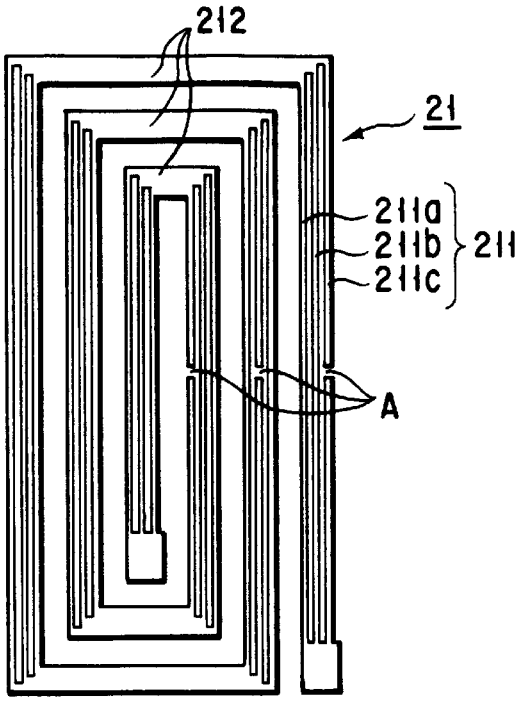
FIGS. 20A, 20B and 20C are plan views of the coil conductor used in third embodiment, indicating the positions where the conductor is cut.
Figure 20B:
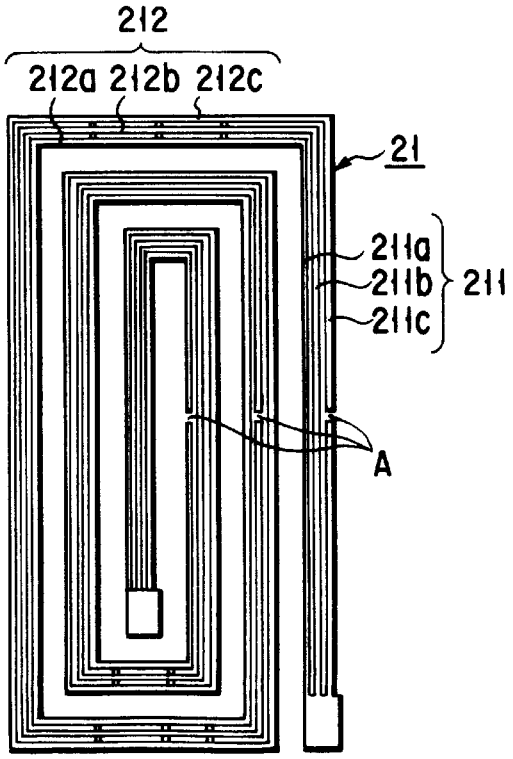
Figure 20C:
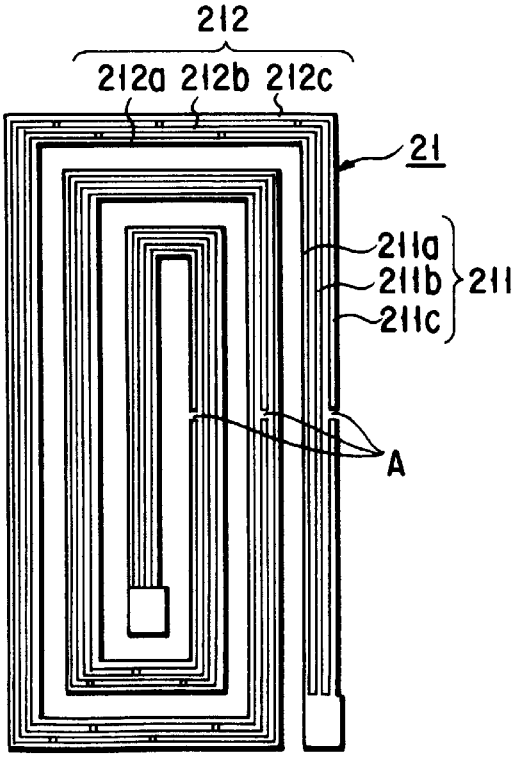

FIGS. 20A, 20B and 20C are plan views of the planer coil 21, indicating the positions A where the conductor lines 211*b,* 211*b* and 211*c* of some of the conductor 211 located in the easy direction of magnetization are cut at positions A. In the case shown in FIG. 20A, the conductors 212 located in the hard direction of magnetization are not cut since they are constituted by a single conductor each. In the case shown in FIGS. 20B and 20C, the conductors 212 are not cut, either, since each of them is constituted by the conductor lines 212*a,* 212*b* and 212*c* which are electrically connected in part. Thus, the planar coil 21 is not cut as a whole in any of the cases shown in FIGS. 20A, 20B and 20C.

As described above, the square spiral planar coil 21 is sandwiched between the insulating layers 22, the layers 22 are sandwiched between the soft-magnetic layers 23, and the layers 23 are made of uniaxial anisotropic material. The third embodiment is not limited to the one shown in FIGS. 17A and 17B. A few modifications will be described, with reference to FIGS. 21A to 24B.

Figure 21A:
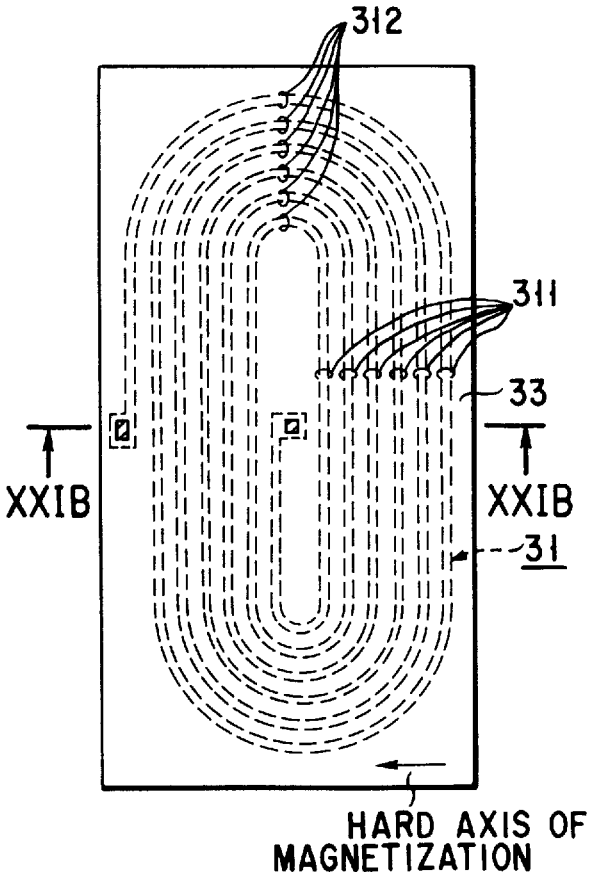
FIGS. 21A and 21B are diagrams showing a planar inductor which is a first modification of the third embodiment, comprising an oblate spiral planer coil.
Figure 21B:
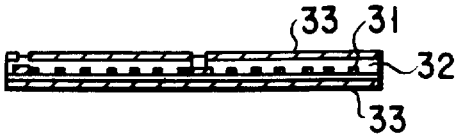

FIGS. 21A and 21B show a planar inductor which is the first modification of the third embodiment. As is seen from FIGS. 21A and 21B, this modification comprises an oblate spiral planer coil 31, two insulating layers 32 sandwiching the coil 31, and two soft-magnetic layers 33 sandwiching the insulating layers 32. The soft-magnetic layers 33 are made of uniaxial anisotropic magnetic material.

Figure 22A:
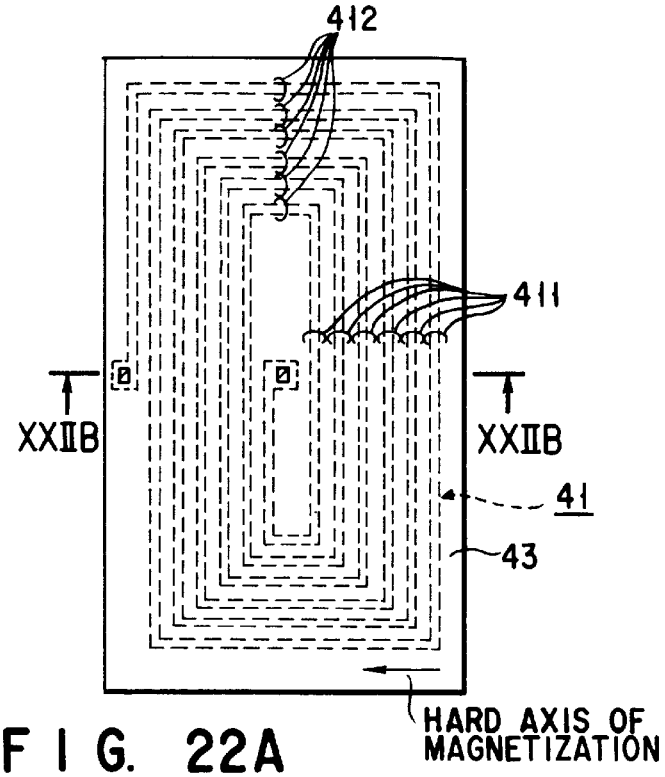
FIGS. 22A and 22B are diagrams showing a planar inductor which is a second modification of the third embodiment, comprising a rectangular spiral planer coil.
Figure 22B:
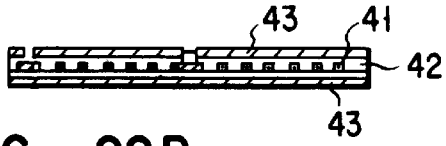

FIGS. 22A and 22B illustrate the second modification of the third embodiment. The second modification comprises a rectangular spiral planar coil 41, two insulating layers 42 sandwiching the coil 41, and two soft-magnetic layers 43 sandwiching the insulating layers 42. The soft-magnetic layers 43 are made of uniaxial anisotropic magnetic material.

Figure 23A:
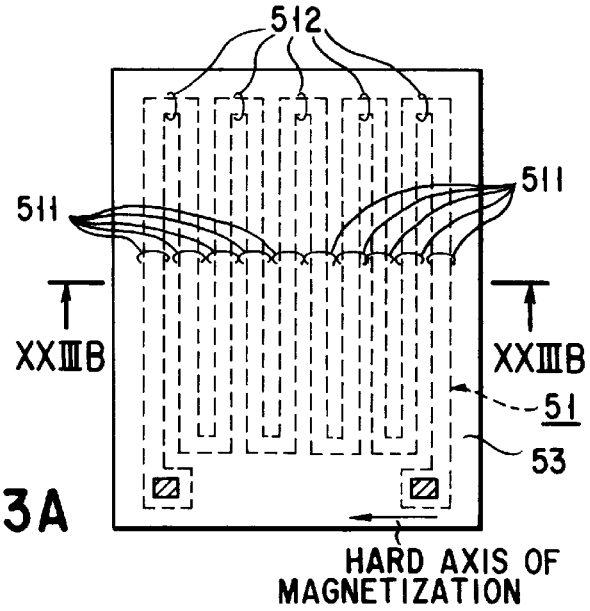
FIGS. 23A and 23B are diagrams illustrating a planar inductor which is a third modification of the third embodiment, comprising a meandering planer coil.
Figure 23B:
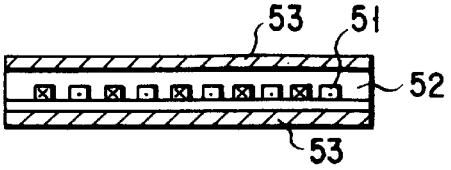

FIGS. 23A and 23B show the third modification of the third embodiment. The third modification comprises a meandering rectangular planer coil 51, two insulating layers 52 sandwiching the soil 51, and two soft-magnetic layers 53 sandwiching the insulating layers 52. The soft-magnetic layers 53 are made of uniaxial anisotropic magnetic material.

In the first modification (FIGS. 21A and 21B), the oblate spiral planar coil 31 is formed of conductors 311 extending substantially parallel to the major axis and conductors 312 extending substantially parallel to the minor axis. The conductors 311 are located in a hard direction of magnetization, each constituted by a plurality of conductor lines (not shown). The conductors 312 are arranged in an easy direction of magnetization, each constituted by a single conductor or by a plurality of conductors lines (not shown) which are electrically connected in part. Since the conductors 311, which form a greater part of the oblate coil 31, are positioned in the hard direction of magnetization, the coil 31 can perform its function with high efficiency.

In the second modification (FIGS. 22A and 22B), the rectangular spiral planar coil 41 is formed of conductors 411 extending lengthwise and conductors 412 extending widthwise. The conductors 411 are located in a hard direction of magnetization, each constituted by a plurality of conductor lines (not shown). The conductors 412 are arranged in an easy direction of magnetization, each constituted by a single conductor or by a plurality of conductors lines (not shown) which are electrically connected in part. Since the conductors 411, which form a greater part of the rectangular coil 41, are positioned in the hard direction of magnetization, the coil 41 can operate efficiently.

In the third modification (FIGS. 23A and 23B), the meandering rectangular spiral planar coil 51 is formed of straight conductors 511 and arcuate conductors 512. The straight conductors 51 are located in a hard direction of magnetization, each constituted by a plurality of conductor lines (not shown). The arcuate conductors 512 are arranged in an easy direction of magnetization, each constituted by a single conductor or by a plurality of conductors lines (not shown) which are electrically connected in part. Since the conductors 511, which form a greater part of the rectangular coil 51, are positioned in the hard direction of magnetization, the coil 51 can operate with high efficiency.

Figure 24A:
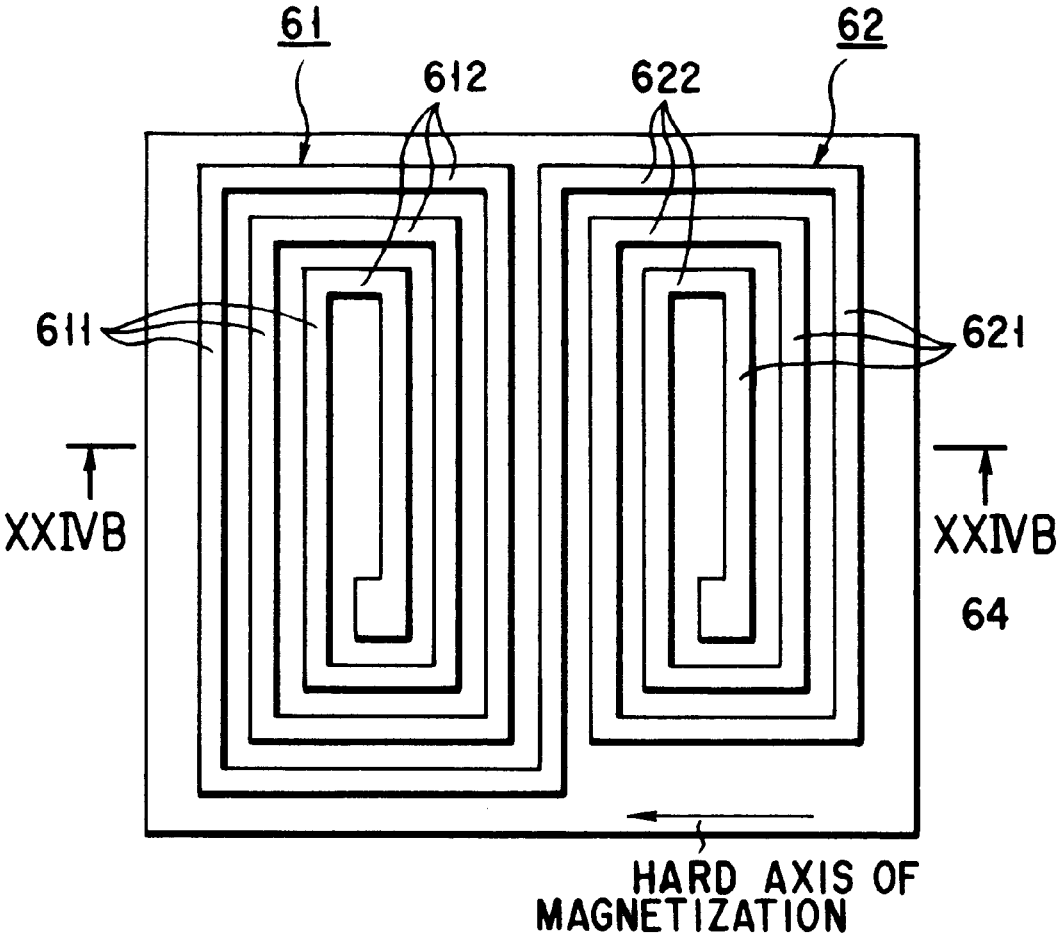
FIGS. 24A and 24B are diagrams showing a planar inductor which is a fourth modification of the third embodiment, comprising two rectangular spiral planer coils.
Figure 24B:
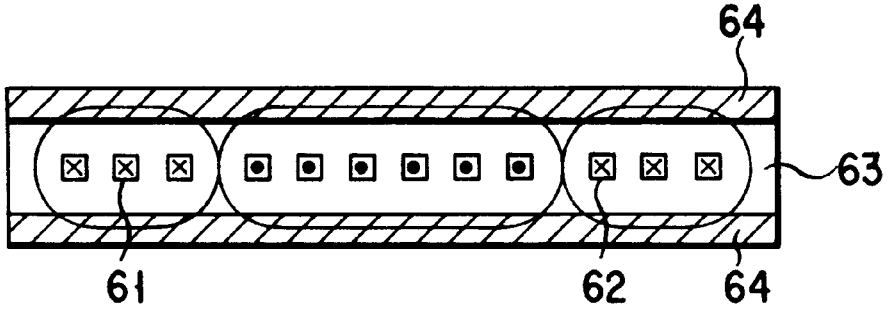

FIGS. 24A and 24B show a planar inductor which is fourth modification of the third embodiment. The fourth modification is different from the first, second and third modifications in that two rectangular spiral planer coils 61 and 62 are used, instead of one planar coil. As shown in FIGS. 24A and 24B, the fourth modification further comprises two insulating layer 63 and two soft-magnetic layers 64. The coils 61 and 62 are interposed between the insulating layers 63, arranged side by side in the same plane and electrically connected in series to each other. The soft-magnetic layers 64 are made of uniaxial anisotropic magnetic material. The first rectangular spiral planar coil 61 is formed of conductors 611 extending lengthwise and located in a hard direction of magnetization and conductors 612 extending widthwise and located in an easy direction of magnetization. Each of the conductors 611 is constituted by a plurality of conductor lines (not shown), whereas each of the conductors 612 is formed of a single conductor or a plurality of conductors lines (not shown) which are electrically connected in part. The second rectangular spiral planar coil 62 is formed of conductors 621 extending lengthwise and located in the hard direction of magnetization and conductors 622 extending widthwise and located in the easy direction of magnetization. Each of the conductors 621 is constituted by a plurality of conductor lines (not shown), whereas each of the conductors 622 is formed of a single conductor or a plurality of conductors lines (not shown) which are electrically connected in part. Since the conductors 611 which form a greater part of the first coil 61, and the conductors 621 which form a greater part of the second coil 62 are positioned in the hard direction of magnetization, both coils 61 and 62 can operate efficiently. Made of two rectangular coils 61 and 62, the planar inductor can have an inductance higher than those of the first to third modifications (FIGS. 21A to 23B).

As described above, any modification of the third embodiment has at least one spiral planar coil which is oblate or rectangular and two soft-magnetic layers which are made of uniaxial anisotropic magnetic material. Nevertheless, the spiral planar coil may be replaced by a circular one, in which case the soft-magnetic layers should better be made of magnetically isotropic material.

Fourth Embodiment

As described above, each of the planar magnetic devices according to the first, second and third embodiments has a planer coil which is interposed between two soft-magnetic layers. The magnetic flux crossing between upper and lower soft-magnetic layers not only increase the AC resistance of the planar coil conductor, but also results in a power loss also in a pad section provided for connecting the device to an external circuit.

Figure 25:
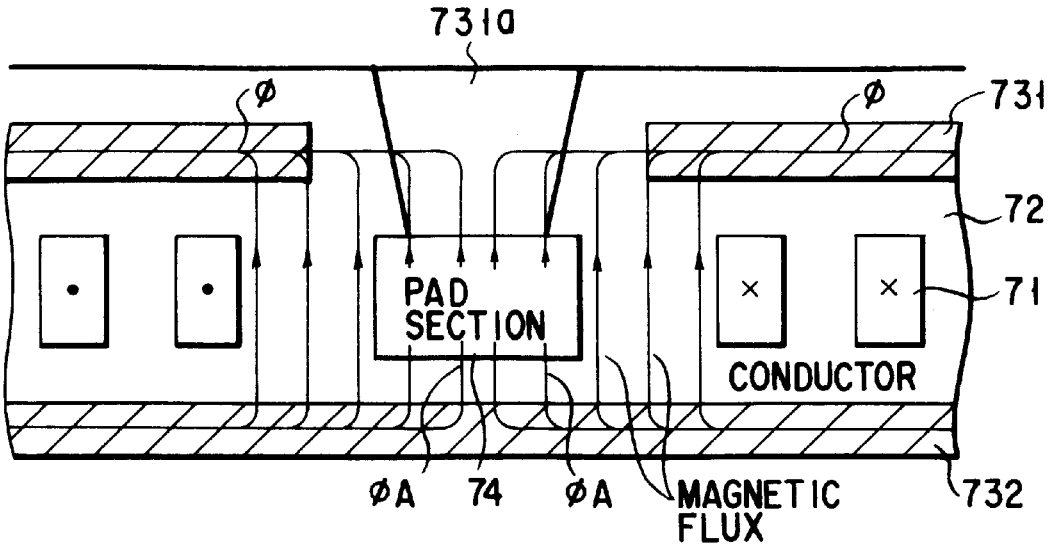
FIG. 25 is a sectional view of a conventional planar inductor, serving to describe a planar inductor which is a fourth embodiment of the present invention.

FIG. 25 shows a conventional planar inductor which has such a pad section. More precisely, this planer inductor comprises a planar coil 71, two insulating layers 72, a pad section 74, an upper soft-magnetic layer 731 and a lower soft-magnetic layer 732. The coil 71 and the pad section 74 interposed between the insulating layers 72. The layers 72 are sandwiched between the soft-magnetic layers 731 and 732. The upper soft-magnetic layer 731 has a hole 731*a*. The pad section 74 is located right below the hole 731*a,* so that bonding wires may extend through the hole 731*a* to be connected through the section 74 to an external circuit.

Figure 26:
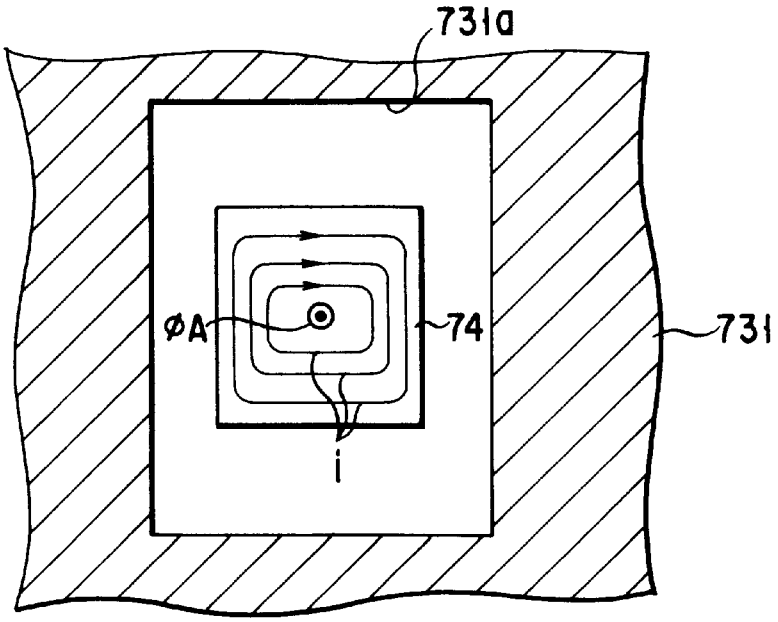
FIG. 26 is a diagram explaining how an eddy current is generated at the pad section of the conventional planar inductor shown in FIG. 25.

In the planar inductor shown in FIG. 25, the planar coil 71 generates a magnetic flux ϕ, which extends in the direction of the arrow shown in FIG. 25. Since the lower soft-magnetic layer 732 has no hole, that part which is located below the pad section 74 absorbs the magnetic flux ϕA. The flux ϕA inevitably passes through the entire pad section 74, while extending toward the upper soft-magnetic layer 731. An eddy current i is generated from the flux ϕA passing through the pad section 74, as is shown in FIG. 26. The eddy current i results in a power loss in the pad section, which increases the AC resistance of the planar coil conductor.

Figure 27:
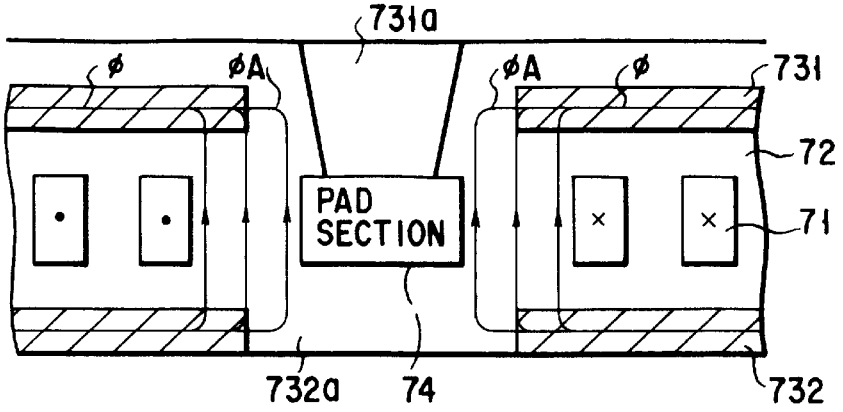
FIG. 27 is a sectional view showing a planar inductor which is a fourth embodiment of the present invention.

FIG. 27 shows a planar inductor according to the fourth embodiment, in which generation of an eddy current in the pad section is suppressed, thereby minimize an increase in the AC resistance of the inductor. In FIG. 27, the components similar or identical to those shown in FIG. 25 are designated at the same reference numerals.

As illustrated in FIG. 27, the fourth embodiment comprises a planar coil 71, two insulating layers 72 sandwiching the coil 71, a pad section 74 interposed between the layers 72, two soft-magnetic layers 731 and 732 sandwiching the insulating layers 72. The upper soft-magnetic layer 731 has a hole 731*a* located right above the pad section 74, and the lower soft-magnetic layer 732 has a hole 732*a* located right below the pad section 74. Both holes 731*a* and 732*a* are larger than the pad section 74.

The holes 731*a* and 732*a* of the soft-magnetic layers 731 and 732 are located above and below the pad section 74 and are much larger than the pad section 74. This means that the soft-magnetic layers 731 and 732 have no layers between which a magnetic flux may extend to pass through the pad section 74. Virtually no portion of the magnetic flux ϕA passes through the pad section 74, and virtually no eddy current is generated in the pad section 74. The power loss in the pad section 74 is therefore small, minimizing the AC resistance of the planar inductor. Hence, the planar inductor can operate with high efficiency.

Figure 28:
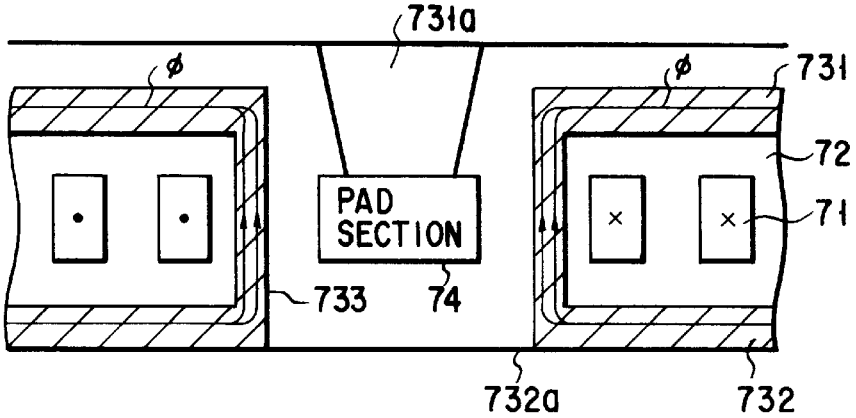
FIG. 28 is a sectional view illustrating a modification of the fourth embodiment.

FIG. 28 shows a modification of the fourth embodiment. The modified planar inductor differs from the planar inductor shown in FIG. 27 in that a hollow magnetic bypass 733 is interposed between the insulating layers 72. The bypass 733 has a size equal to the size of the holes 731*a* and 732*a* and connects the soft-magnetic layers 731 and 732.

In the modified planar inductor shown in FIG. 28, all magnetic flux ϕ extending from the lower soft-magnetic layer 732 toward the upper soft-magnetic layer 731 passes through the bypass 733. No magnetic flux passes through the pad section 74. This suppresses generation of an eddy current in the pad section 74 more reliably than in the fourth embodiment (FIG. 27). The power loss in the pad section 74 is therefore smaller. The modified planar inductor has an AC resistance lower than that of the inductor shown in FIG. 27 and can operate with a higher efficiency.

Fifth Embodiment

Figure 29:
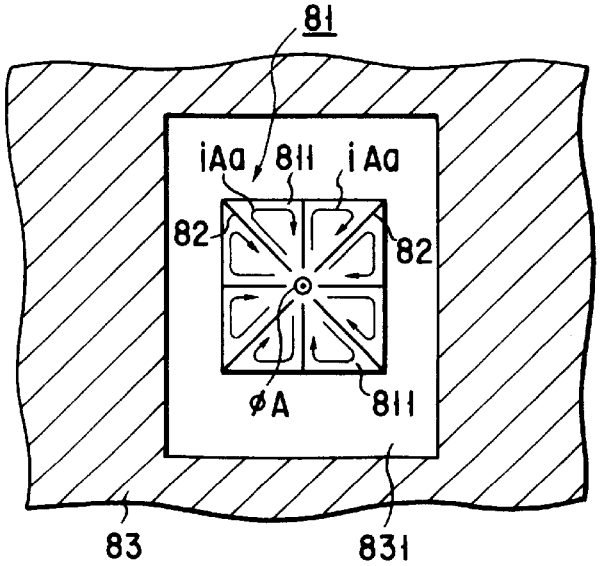
FIG. 29 is a diagram showing the pad section of the planar inductor according to a fifth embodiment of the present invention.

FIG. 29 shows the pad section of a planar inductor which is the fifth embodiment of the present invention. The fifth embodiment is characterized in that the pad section has a number of notches to reduce the influence of an eddy current, whereas an eddy current in the pad section 74 is suppressed for the same objective in the fourth embodiment.

More specifically, as shown in FIG. 29, eight notches 82 are cut in the four corners and four sides of a square pad section 81, all extending to the center part. The notches 82 thus cut divides the pad section 81 into eight regions 811. The regions 811 are electrically connected at the center part of the pad section 81. As shown in FIG. 29, the upper soft-magnetic layer 83 has a hole 831, exactly in the same way as in the fourth embodiment shown in FIG. 27.

Suppose a magnetic flux ϕA passes through the center part of the pad section 81, generating an eddy current in the section 81. Then, the notches 82 divide the loop of the eddy current into small eddy currents iAa, which are confined in the respective regions 811. The power loss in the entire pad section 81, which results from the small eddy currents iAa, is less than in the case where the section 81 has no notches at all. The planar inductor therefore has a relatively low AC resistance and can operate with a higher efficiency.

As has been described above, an increase in the resistance of the planar coil conductor, which occurs in a high-frequency band, can be suppressed in any embodiment of the present invention. The high-frequency loss can therefore be reduced in the planar magnetic device of the present invention. Hence, the device can have its quality factor Q increased to a maximum value. It can efficiently function as either a planar inductor or a planar transformer.

The planar magnetic device according to this invention may have two spiral planar coils arranged side by side in the same plane and electrically connected to each other. In this case, the device can be used as a planar inductor which has a large inductance.

The eddy current generated in the soft-magnetic layers incorporated in the planar magnetic device of the invention is small since the layers are made of uniaxial anisotropic material. Thus, the high-frequency loss in the soft-magnetic layers is proportionally small. Further, the planar coil or coils provided in the planar device perform their function with high efficiency since a greater part of the coil or coils is located in a difficult direction of magnetization. Additionally, the planar coil 21 is not cut as a whole even if some of the coil conductors are cut. The planar coil can, therefore, be manufactured at a high yield and at low cost.

Moreover, the present invention can provide a planar magnetic device comprising two soft-magnetic layers, a planar coil interposed between the layers and having an opening at the center, and a pad section interposed between the layers and located in the opening of the coil. The soft-magnetic layers have a hole each, which is larger than the pad section and concentric with the pad section. Hence, no portion of the magnetic flux extending from one soft-magnetic layer to the other soft-magnetic layer passes through the pad section. This suppresses generation of an eddy current in the pad section. The power loss in the pad section is therefore small. The planar magnetic device has a relatively low AC resistance and can operate with a high efficiency.

Furthermore, the present invention can provide a planar magnetic device in which a number of notches are cut in the pad section, dividing the section into a plurality of regions. The notches divide the loop of an eddy current generated in the pad section when a magnetic flux passes through the section, into small eddy currents. In other words, the small currents are confined in the respective regions. The power loss in the entire pad section, which results from the small eddy currents, is less than otherwise. The planar magnetic device therefore has a relatively low AC resistance and can operate with a high efficiency. Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A planar magnetic device used as a power supply, comprising:

at least one planar coil formed of a spiral coil conductor line, said spiral coil conductor line being divided into a plurality of sub-conductor lines;

two insulating layers sandwiching said at least one planar coil; and two soft-magnetic layers sandwiching said insulating layers.

2. The device according to claim 1, wherein said at least one planar coil includes a deposited and etched conductive film on one of said insulating layers.

3. The device according to claim 1, wherein one planar coil is sandwiched between said insulating layers.

4. The device according to claim 1, wherein at least two planar coils are sandwiched between said insulating layers and are positioned one above another, and insulating layers are interposed between said at least two planar coils.

5. The device according to claim 1, wherein said at least one planar coil is constituted by two spiral planar coils arranged side by side in the same plane and electrically connected to each other.

6. The device according to claim 1, wherein said soft-magnetic layers are made of uniaxial anisotropic material and have a hard axis of magnetization and an easy axis of magnetization.

7. The device according to claim 6, wherein said at least one planar coil includes a deposited and etched conductive film on one of said insulating layers.

8. The device according to claim 6, wherein one planar coil is sandwiched between said insulating layers.

9. The device according to claim 6, wherein at least two planar coils are sandwiched between said insulating layers and are positioned one above another, and insulating layers are interposed between said at least two planar coils.

10. The device according to claim 6, wherein said at least one planar coil is constituted by two spiral planar coils arranged side by side in the same plane and electrically connected to each other.

11. The device according to claim 6, wherein said at least one planar coil is a rectangular spiral planar coil having long side conductors located in the easy axis of magnetization of said soft-magnetic layers and short side conductors in the hard axis of magnetization of said soft-magnetic layers.

12. The device of claim 6, wherein said at least one planar coil is a rectangular spiral planar coil comprised of conductors extending parallel to a major axis and located in the hard direction of magnetization of said soft-magnetic layers and conductors extending parallel to a minor axis and located in the easy direction of magnetization of said soft-magnetic layers.

13. The device according to claim 12, wherein each of the conductors of said rectangular spiral coil, which extended parallel to the minor axis, is a single conductor.

14. The device according to claim 12, wherein each of the conductors of said rectangular spiral coil, which extended parallel to the minor axis, is a plurality of conductor lines electrically connected in part.

15. The device according to claim 6, wherein said at least one planar coil is an oblate spiral planar coil comprised of straight conductors located in the easy axis of magnetization of said soft-magnetic layers and arcuate conductors in the hard axis of magnetization of said soft-magnetic layers.

16. The device according to claim 15, wherein each of the arcuate conductors of said oblate spiral coil is a single conductor.

17. The device according to claim 15, wherein each of the arcuate conductors of said oblate spiral coil is a plurality of conductor lines electrically connected in part.

18. The device according to claim 16, wherein said at least one planar coil includes a deposited and etched conductive film on one of said insulating layers.

19. The device according to one of claims 16, 17, 13, or 14, wherein one planar coil is sandwiched between said insulating layers.

20. The device according to one of claims 16, 17, 13, or 14, wherein at least two planar coils are sandwiched between said insulating layers and are positioned one above another, and insulating layers are interposed between said at least two planar coils.

21. The device according to one of claims 16, 17,13, or 14, wherein said at least one planar coil is constituted by two spiral planar coils arranged side by side in the same plane and electrically connected to each other.

22. The device according to claim 1, further comprising:

a pad section to be connected to an external circuit, wherein each of the two soft-magnetic layers includes a hole in correspondence with said pad section.

23. The device according to claim 22, further comprising a magnetic bypass interposed between said soft-magnetic layers, located at a side of the holes of said soft-magnetic layers and connecting said soft-magnetic layers.

24. The device according to claim 1, further comprising:

a pad section, which is to be connected to an external circuit, having a plurality of notches cut in edges thereof, said notches dividing the pad section into a plurality of regions.

25. The device according to claim 24, wherein said soft-magnetic layers each have a hole in correspondence with said pad section.

26. A planar magnetic device used as a power supply, comprising:

at least one planar coil formed of a coil conductor consisting of a plurality of sub-conductor lines;

two insulating layers sandwiching said at least one planar coil; and two soft-magnetic layers sandwiching said insulating layers.

27. The device according to claim 26, wherein the plurality of sub-conductor lines reduces eddy currents.

28. A planar magnetic device used as a power supply, comprising:

at least one planar coil formed of a spiral coil conductor line, said spiral coil conductor line being divided into a plurality of sub-conductor lines wherein:

said at least one planar coil formed of a spiral conductor line is formed as a rectangular spiral planar coil formed of a coil conductor line which has a long side conductor line and a short side conductor line;

two insulating layers sandwiching said at least one planar coil; and two soft-magnetic layers sandwiching said insulating layers, wherein each of said two soft-magnetic layers is made of uniaxial anisotropic material and has a hard axis of magnetization and an easy axis of magnetization, said long side conductor line extends along said easy axis of magnetization and is divided into a plurality of sub-conductor lines, and said short side conductor line extends along said hard axis of magnetization.

29. A planar magnetic device used as a power supply, comprising:

at least one planar coil formed of a spiral coil conductor line, said spiral coil conductor line being divided into a plurality of sub-conductor lines;

two insulating layers sandwiching said at least one planar coil; and two soft-magnetic layers sandwiching said insulating layers, wherein respective ends of each of said plurality of sub-conductor lines are electrically connected to each other at respective nodes.

30. A planar magnetic device used as a power supply, comprising:

at least one planar coil formed of a coil conductor consisting of a plurality of sub-conductor lines;

two insulating layers sandwiching said at least one planar coil; and two soft-magnetic layers sandwiching said insulating layers, wherein respective ends of each of said plurality of sub-conductor lines are electrically connected to each other at respective nodes.

31. A planar magnetic device used as a power supply, comprising:

at least one planar coil formed of a spiral coil conductor line, said spiral coil conductor line being divided into a plurality of sub-conductor lines, respective ends of each of said plurality of sub-conductor lines being electrically connected to each other at respective nodes, wherein said at least one planar coil is formed as a rectangular spiral planar coil formed of a coil conductor line which has a long side conductor line and a short side conductor line;

two insulating layers sandwiching said at least one planar coil; and two soft-magnetic layers sandwiching said insulating layers, wherein each of said two soft-magnetic layers is made of uniaxial anisotropic material and has a hard axis of magnetization and an easy axis of magnetization, said long side conductor line extends along said easy axis of magnetization and is divided into a plurality of sub-conductor lines, and said short side conductor line extends along said hard axis of magnetization.

* * * * *